United States Patent [19]

Umeda et al.

[11] Patent Number: 4,802,557

[45] Date of Patent: Feb. 7, 1989

[54] WAIT TIME PREDICTION APPARATUS FOR ELEVATOR

[75] Inventors: Yasukazu Umeda; Shintaro Tsuji, both of Inazawa, Japan

[73] Assignee: Mitsubishi Denki Kabushiki Kaisha, Japan

[21] Appl. No.: 17,695

[22] Filed: Feb. 24, 1987

[30] Foreign Application Priority Data

Feb. 25, 1986 [JP] Japan ..... 61-39615

[51] Int. Cl.[4] ..... B66B 1/18

[52] U.S. Cl. ..... 187/127

[58] Field of Search ..... 187/121, 124, 125, 127, 187/129, 130, 137

[56] References Cited

U.S. PATENT DOCUMENTS 4,030,572 6/1977 Kaneko et al. ..... 187/125
4,244,450 1/1981 Umeda et al. ..... 187/124
4,582,173 4/1986 Schroder ..... 187/127

FOREIGN PATENT DOCUMENTS 57-16067 4/1982 Japan .
5924061 6/1982 Japan .
2110423 6/1983 United Kingdom ..... 187/127

*Primary Examiner*—William M. Shoop, Jr.
*Assistant Examiner*—W. E. Duncanson, Jr.
*Attorney, Agent, or Firm*—Leydig, Voit & Mayer

[57] ABSTRACT

A wait time prediction apparatus for an elevator which takes into consideration the difficulty in measuring actual waiting times of individual users for the group supervision of the elevator and provides apparatus to record the registration time of each call and the number of getting-on persons corresponding to the call, to accumulate such records so as to provide a function defining the average number of passengers getting on the elevator corresponding to each call registration time, and to integrate the function with respect to the call registration times for a predetermined period of time and to use the result as a predictive summation of the actual waiting times of the individual passengers getting on an elevator which serves a call after a predetermined time from the registration of the call, which cannot be directly measured.

6 Claims, 3 Drawing Sheets

WAIT TIME PREDICTION APPARATUS FOR ELEVATOR

BACKGROUND OF THE INVENTION

This invention relates to a wait time prediction apparatus for an elevator which predicts the wait times of users waiting in elevator halls, the wait times being information effective for performing an elevator control.

For the purpose of efficiently operating the cages of an elevator as a group and rendering favorable services to passengers, it is important to predict the wait times of the users waiting in elevator halls.

In this regard, it is generally difficult to consider the wait times of the individual users. Therefore, the wait times are often substituted by the periods of time (call registration times) taken between the registrations of calls and the cancellations thereof owing to the arrivals of the cages.

With this measure, however, the same result is produced whether one person or twenty persons is/are waiting in a hall, and the wait times of the individual persons are not considered in the true sense.

It has therefore been proposed to predict the numbers of waiting users at the arrivals of cages and to weight call registration times in correspondence with the numbers of waiting users, so as to utilize the resulting data for the group supervision. An example of the prediction of the numbers of waiting users is disclosed in the official gazette of Japanese Patent Application Publication No. 57-16067, while an example of the weighting with the numbers of waiting users is disclosed in the official gazette of Japanese Patent Application Publication No. 59-24061.

FIG. 5 shows a block diagram in which the above two examples are outlined in combination. Referring to the figure, a service prediction time-calculating device 101 calculates the period of time between the registration of a call and the arrival of a cage, a waiting user appearance rate-setting unit 102 serves to previously set the number of waiting users who appear per unit time, a predictive waiting user number-calculating device 103 predicts the number of waiting users who arrive after the registration of the call, from the outputs of the service prediction time-calculating device 101 and the waiting user appearance rate-setting unit 102, and a waiting user number-detecting device 104 measures the number of waiting users at the registration of the call.

The outputs of the waiting user number-detecting device 104 and the predictive waiting user number-calculating device 103 are added by an adder 105, and the sum result and the output of the service prediction time-calculating device 101 are multiplied by a multiplier 106.

In the arrangement of FIG. 5, it is assumed by way of example that an up call on the first floor be registered. When it is predicted that a cage to serve the call will arrive after 34 seconds, the output of the service prediction time-calculating device 101 becomes "34".

Besides, when it is known that one waiting person appears in 10 seconds in the up direction on the first floor, a rate of 1 (person)/10 (seconds) is set with the waiting user appearance rate-setting unit 102, and the output of this unit becomes "0.1."

It is accordingly presumed that waiting users of 0.1 (person/second)$\times$34 (seconds)$=$3.4 (persons) will appear after the registration of the call, so the output of the predictive waiting user number-calculating device 103 becomes 3.4.

Assuming that only one person who has registered the call be the waiting user at the registration of the call, the output of the waiting user number-detecting device 104 becomes 1, and the output of the adder 105 becomes 4.4. That is, it is presumed that there will be 4.4 waiting users at the arrival of the cage. Besides, the output of the multiplier 106 becomes $34\times4.4=149.6$.

This indicates that, in case of performing the group supervision, the up call on the first floor is not handled as 34 seconds but is weighted by 4.4 by estimating the wait times of the individual users. For example, in a system wherein cages are assigned so as to reduce the summation of wait times in the whole building, the wait time on only the first floor becomes 149.6 seconds.

Even with this method, however, the wait times of the individual persons in the true sense are not considered. The reason is that, although the wait time of the person having registered the call is really 34 seconds, those of the other 3.4 persons ought to be less than 34 seconds as these persons arrive later.

In an extreme case, there might be a person who comes to the hall immediately before the arrival of the cage, and the wait time of the person ought to be substantially zero second.

It is desired to make the weighting somewhat smaller with this fact taken into account. Such weighting, however, does not produce a very significant value because the waiting users do not always arrive at equal intervals but they often arrive as groups.

There has been the problem that unless the wait times of the persons other than the person having registered the call can be predicted, the accurate wait times of the individual waiting users are not calculated, making it impossible to perform the group supervision according to which the wait times of the individual users in the true sense become small as the total.

SUMMARY OF THE INVENTION

This invention has the objective to solve such a problem, and has for its main object to provide a wait time prediction apparatus for an elevator which can predict the summation of the wait times of individual users waiting in a hall for use in group supervision.

The wait time prediction apparatus for an elevator according to this invention comprises means to record the registration time of a call and the number of getting-on persons corresponding to the call and to totalize such records so as to predict the wait times of the users.

In this invention, a function which indicates the relationship between the call registration time and the number of passengers is found, and the number of passengers is integrated versus time in accordance with the function, thereby to obtain a predictive wait time.

PREFERRED EMBODIMENT OF THE INVENTION

Figure 1:
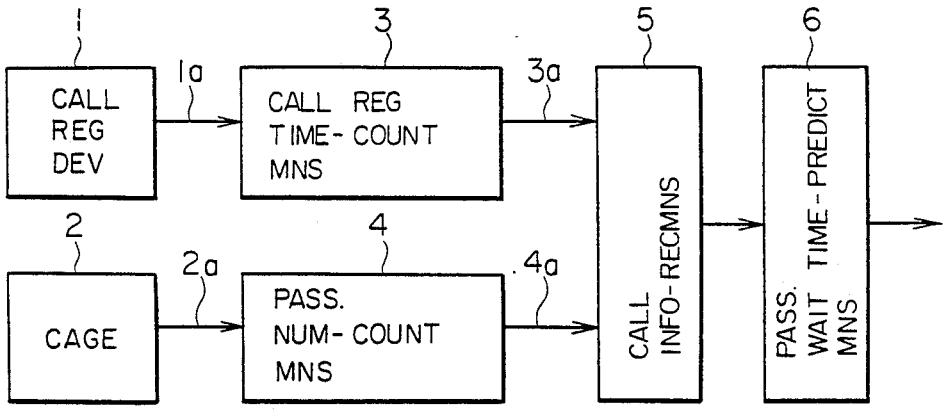
FIG. 1 is a block diagram showing the arrangement of an embodiment of a wait time prediction apparatus for an elevator according to this invention.

Now, an embodiment of a wait time prediction apparatus for an elevator according to this invention will be described with reference to FIGS. 1–4. FIG. 1 is a diagram showing the arrangement of the embodiment. Numeral 1 in the figure designates a call registration device which registers a call in a hall, and which delivers a call registration signal 1*a*. Numeral 2 designates the cage of the elevator, the output status signals 2*a* of which are the signals of cage statuses such as the number of passengers and the position of the cage.

Call registration time-counting means 3 counts the period of time during which the call is registered. It receives the call registration signal 1*a* from the call registration device 1, and delivers the call registration time 3*a* to call information-recording means 5.

Passenger number-counting means 4 counts the number of users who get in the cage serving the call, and it delivers the number of passengers 4*a* to the call information-recording means 5. This call information-recording means 5 records the call registration times 3*a* and the corresponding numbers of passengers 4*a*.

Using the records of the call information-recording means 5, passenger wait time-predicting means 6 predicts the summation of the wait times of the individual passengers and delivers a predictive total passenger wait time 6*a*. That is, a function y=f(x) is obtained from the relationship between the call registration time x and the average number of passengers y, and for a predetermined period of time t, $$\int_0^t f(x)\,dx$$

is predicted as the summation of the wait times of the individual passengers.

Figure 2:
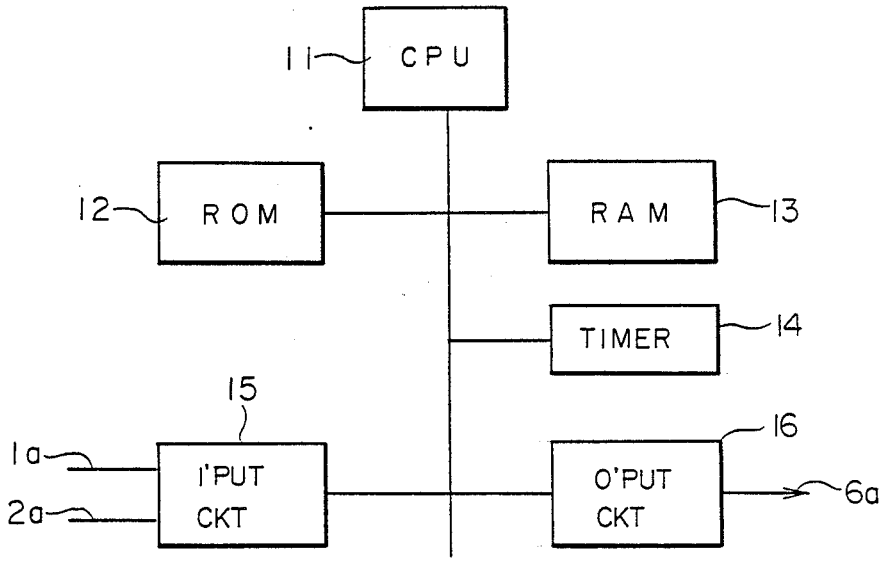
FIG. 2 is a diagram showing the system architecture of call registration time-counting means, passenger number-counting means, call recording means and passenger wait time-predicting means in the elevator wait time prediction apparatus in FIG. 1.

FIG. 2 shows the system architecture of the call registration time-counting means 3, the passenger number-counting means 4, the call information-recording means 5 and the passenger wait time-predicting means 6. The illustrated system comprises a microprocessor which is used as a central processing unit (CPU) 11, a read-only memory (ROM) 12 which stores a processing program for controlling this system, a random access memory (RAM) 13 which stores processed data, a timer 14 which applies an interrupt to the CPU 11 after a prescribed period of time, an input circuit 15 which receives the call registration signal 1*a* and the cage status signals 2*a*, and an output circuit 16 which delivers the predictive total passenger wait time 6*a*.

Figure 3:
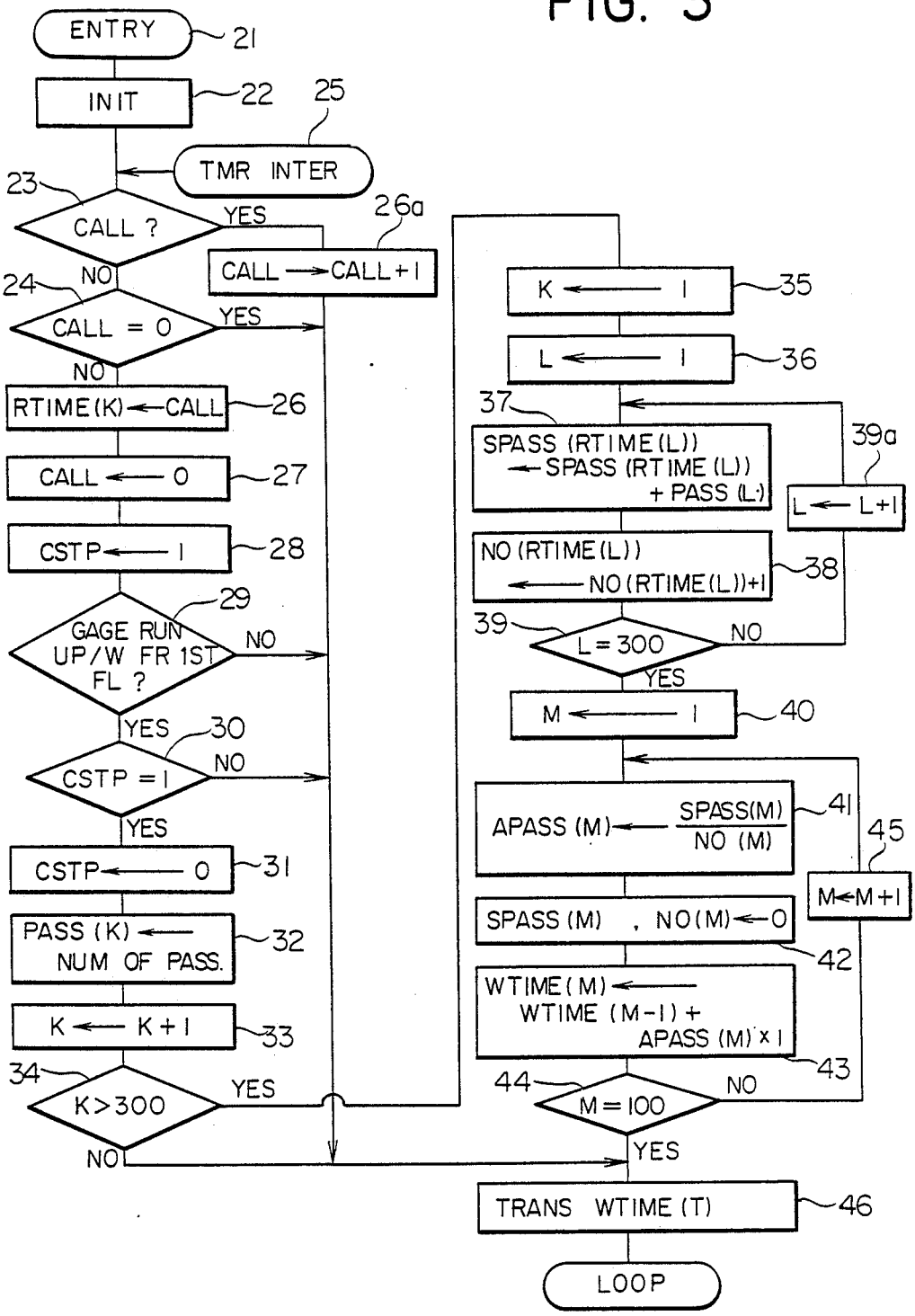
FIG. 3 is a flow chart showing the content of a program which is set in a ROM in FIG. 2.

FIG. 3 shows the content of the program which is fixedly set in the ROM 12. Numerals 21–47 indicate the steps of the flow chart.

Figure 4:
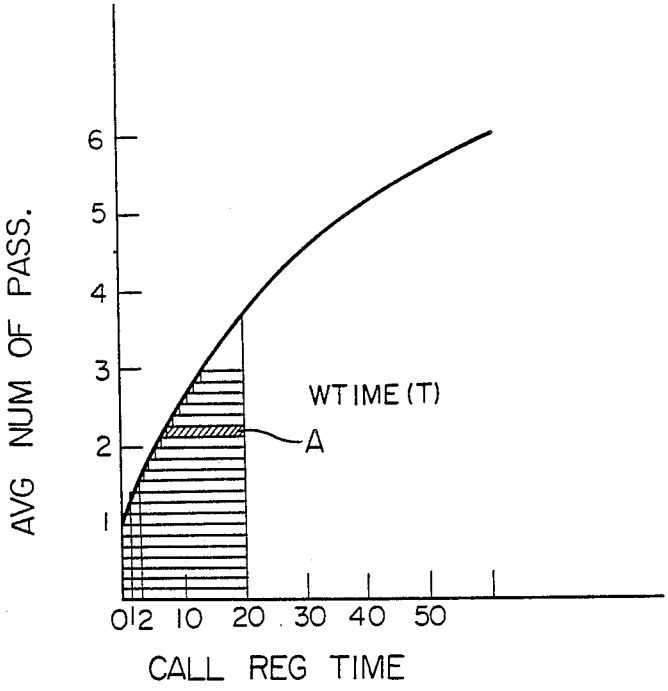
FIG. 4 is a graph showing a call registration time T, an average number of passengers APASS (T), and a predictive total passenger wait time WTIME (T)
Figure 5:
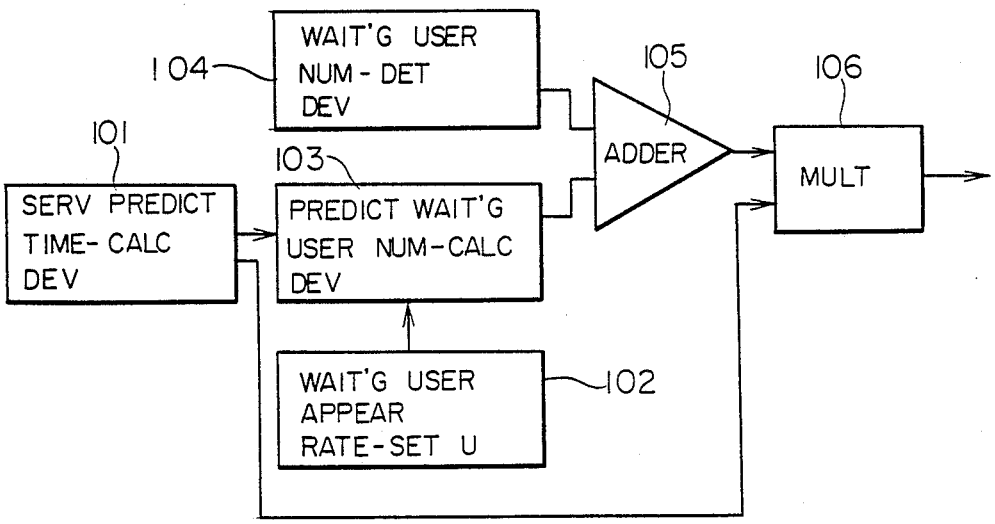
FIG. 5 PRIOR ART
FIG. 5 is a block diagram showing the arrangement of a wait time prediction apparatus in a prior art.

Table 1 indicates an example in which the call registration times 3*a* and the numbers of passengers 4*a* are recorded. FIG. 4 is a graph showing the call registration time T, the average number of passengers APASS (T) and the predictive total passenger wait time WTIME (T).

TABLE 1

| K | RTIME (K) | PASS (K) |
|---|---|---|
| 1 | 34 | 4 |
| 2 | 5 | 2 |
| 3 | 28 | 6 |
| 4 | 14 | 3 |
| 5 | 20 | 5 |
| . | . | . |
| . | . | . |
| . | . | . |

Next, the operation of the embodiment will be described by chiefly referring to FIG. 3. First, variable names used in FIG. 3 and the contents thereof will be listed below in alphabetical order:

APASS(i): Average number of passengers in the case of a call registration time of i seconds. (i=constant. The same applies hereinbelow.)

CALL: Call continuation time. "0" in the absence of a call.

CSTP: Signal indicative of passenger service in progress. "1" until a cage starts from the first floor in response to a call, and "0" at any other time.

K: Constant.

L: Constant.

M: Constant.

NO(i): Number of calls whose call registration time is i seconds.

PASS(i): Number of passengers of the i-th occurring call.

RTIME(i): Call registration time of the i-th occurring call.

SPASS(i): Sum of the numbers of passengers of the calls having the call registration time of i seconds.

T: Call registration time to afford the summation of the wait times of individual passengers.

WTIME(i): Summation of the wait times of individual passengers in the case of the call registration time of i seconds.

The control of the system is started at the step 21. The step 22 sets the variables other than K to "0" and sets K to "1," thereby to initialize the system so that the interrupt intervals of the timer may become 1 second.

The step 23 checks if the call registration signal 1*a* delivered from the call registration device 1 has been received through the input circuit 15. In this example, only an up call on the first floor shall be considered. In the absence of the call, the step 24 checks if there was not the call in the preceding control cycle, either.

When there was not the call in the preceding cycle, either, the control flow proceeds to the step 46, and the program is brought into a loop state at the step 47 (the step 46 will be explained later). Here, when an interrupt signal is received from the timer 14 after 1 second, the program starts from the step 25.

Assuming that the call had occurred at the step 23, the control flow proceeds to the step 26*a*, at which the call continuation time is incremented by "1." Since the time CALL has been set to "0" at the initialization, it becomes "1" at the first cycle from the occurrence of the call, and the control flow proceeds to the step 46.

In this way, as long as there is the call, the data CALL indicative of the call continuation time is incremented by "1" in each cycle. When, at the 35th cycle, a cage responds to the call and this call disappears, the control flow proceeds to the step 24. Now that the data CALL was not "0" in the preceding cycle, the step 24 is followed by the step 26, at which the value of CALL is put into RTIME(K).

Since K=1 holds now, RTIME(1)=34 holds. That is, the call registration time of the first occurring call becomes 34 seconds.

Subsequently, for the purpose of the next calculation, the call continuation time CALL is set to "0" at the step 27, and the under-call-service signal CSTP is set to "1" at the step 28. This signal of "1" indicates that a cage arrives to serve the first-floor up call.

At the next step 29, if the cage runs upwards from the first floor is detected by receiving the cage status signal 2a from the cage 2 through the input circuit 15. While users are still getting in the cage, the decision of this step 29 is "NO." When the cage starts, the decision is "YES," and the flow proceeds to the step 30.

The step 30 checks if the cage has really served the call. Subject to "YES," the under-call-service signal CSTP is set to "0" at the step 31, whereupon the number of passenger is detected at the step 32 by receiving the cage status signal 2a from the cage 2 through the input circuit 15.

The number of passengers is usually found by measuring a weight by means of a "weighing instrument" which is disposed at the bottom of the cage. In this example, assuming that the first floor be the lowermost floor and that there be no underground floor, the number of passengers who are in the cage at the start thereof can be directly regarded as the number of persons who have got in the cage on the first floor.

On any intermediate floor, one or more persons might already be in the cage. Therefore, the number of passengers who have got in the cage on the intermediate floor is evaluated in such a way that the number of passengers at the time at which the weight has become the lightest during the stoppage of the cage on the floor (at the time at which getting-off passengers have got off) is subtracted from the number of passengers at the time at which the cage starts. In this example, assuming the result of the subtraction to be four (persons), PASS(1)=4 holds.

Thus, the call registration time of the first call becomes 34 seconds, and the number of passengers on that occasion becomes four persons.

At the next step 33, the variable K is incremented by "1" so as to record the call registration time and the number of passengers concerning the next call. It is assumed that the call registration time of the second call be 5 seconds, while the number of passengers corresponding thereto be 2 persons, and that the call registration time of the third call be 28 seconds, while the number of passengers corresponding thereto be 6 persons. In this way, a table as exemplified by Table 1 can be formed.

When the variable K has reached 301, that is, when 300 calls have been recorded, the step 34 is followed by the step 35, at which the prediction of a wait time is started. At the step 35, the variable K is reset to "1," whereupon the total of the numbers of passengers for the individual call registration times and the number of the calls are found.

More specifically, after setting the constant L to "1" at the step 36, the numbers of passengers are added on at the step 37. The call registration time RTIME(1) of the call whose call occurrence order is "1" is "34," and the number of passengers PASS(1) thereof is "4," so that "4" enters the sum SPASS(34) first.

The step 38 adds on the number of the calls, and "1" enters the number of calls NO(34) first. In this manner, the adding operations are executed for the 300 calls. Unless L=300 is reached at the step 39, the control flow proceeds to the step 39a, at which the constant L is incremented by "1" so as to process the next call. Meanwhile, when the processing of the 300 calls has ended, the control flow proceeds from the step 39 to the step 40.

After the constant M is set to "1" at the step 40, the average numbers of passengers for the respective call registration times are calculated at the step 41. Assuming that the number of the calls having the call registration time of 1 second be "10" and that the total of the numbers of passengers be "12", SPASS(1)/NO(1)=1.2 holds, which signifies that the average number of passengers APASS(1) is 1.2.

SPASS(M) and NO(M) are reset to "0" at the step 42 for the purpose of the calculations of the next 300 calls, whereupon the summation of the wait times of the individual passengers for each call registration time is evaluated at the step 43.

When the call registration time is 1 second, the summation becomes WTIME(1)=WTIME(0-)+APASS(1)×1=0+1.2=1.2 (second). Here, "1" by which APASS(1) is multiplied is based on the fact that the intervals are 1 second.

Assuming that the average number of passengers be 1.3 person for a call registration time of 2 seconds, the summation of the wait times of the individual passengers becomes WTIME(2)=WTIME(1-)+APASS(2)×1=1.2+1.3=2.5 (seconds). This operation is repeated by the steps 44 and 45 until M=100 is held. The value "100" merely sets the upper limit of the call registration times to be calculated, to 100 seconds, and it has no important significance.

When, in this way, the relationship between the call registration times and the average numbers of passengers becomes as shown in FIG. 4, the area of an oblique-line part indicates the summation WTIME(T). That is, the summation becomes an integral value obtained for a function which specifies the relationship between the call registration times and the average numbers of passengers.

The reason why the quantity WTIME(T) becomes the summation of the wait times is that, when lateral lines are drawn as indicated in FIG. 4, persons in a number corresponding to a height in the vertical direction are expressed by a wait time corresponding to a length in the horizontal direction.

That is, in the unit number of persons indicated by letter A in FIG. 4 (0.2 person in this case), the wait time becomes about 13 seconds. When 0.2-person units thus having various wait times are collected, the summation of the wait times of the individual passengers for a call registration time of 20 seconds is evaluated.

The step 46 transfers the summation WTIME(T) of the wait times of the individual passengers for the call registration time T, through the output circuit 16, and leads to the step 47. The value "T" is usually afforded as an argument by a program which actually allots calls.

Although the embodiment has referred to only the up call on the first floor, naturally the other calls are similarly processed.

Although the call has been checked every second and the registration times have been recorded in seconds, the periods of time can be altered. By way of example, it is also allowed to check the call every 0.1 second and to record the registration times every range of 5 seconds.

Moreover, the device for detecting the number of passengers is not restricted to the cage-bottom weighing instrument, but various other instruments are considered such as an instrument which counts the number of persons at the doorway of a cage with ultrasonic waves and an instrument which counts the number of waiting users in a hall with infrared radiation or the like.

Further, in a case where unlike the object of this invention, the number of passengers at the arrival of a cage is predicted for a given service prediction time, the use of the graph in FIG. 4 makes it possible to obtain more accurate information available with known examples.

As described above, this invention records the call registration times and the numbers of passengers and predicts the wait times of the passengers from the statistic results thereof, so that the wait times of the individual passengers can be predicted to enhance the performance of group supervision.

What is claimed is:

1. A wait time prediction apparatus for an elevator comprising call registration time-counting means for counting registration times of calls which have been registered in order to assign cages, passenger number-counting means for counting numbers of passengers who get on the cages serving the calls, call information-recording means for recording the call registration times and the numbers of passengers for the respective calls for a predetermined number of calls, and passenger wait time-predicting means providing a predictive summation of the actual waiting times of individual passengers getting on an elevator which serves a call after a predetermined time from the registration of the call on the basis of outputs of said call information-recording means.

2. A wait time prediction apparatus for an elevator comprising call registration time-counting means for counting registration times of calls which have been registered in order to assign cages, passenger number-counting means for counting numbers of passengers who get on the cages serving the calls, call information-recording means for recording the call registration times and the numbers of passengers for the respective calls for a predetermined number of calls, and passenger wait time-predicting means providing a prediction summation of the actual waiting times of individual passengers getting on a cage which serves a call after a predetermined time (t) from the registration of the call by integrating a function $y=f(x)$ for the predetermined period of time (t), $$\int_0^t f(x)\,dx$$

wherein said function $y=F(x)$ is obtained from a relationship between the call registration times (x) and the average numbers of passengers (y).

3. A wait time prediction apparatus for an elevator comprising call registration time-counting means for counting registration times of calls which have been registered in order to assign cages, passenger number-counting means for counting numbers of passengers who get on the cages serving the calls, call information-recording means for recording the call registration times and the numbers of passengers for the respective calls for a predetermined number of calls, and passenger wait time-predicting means providing a predictive summation of the actual waiting times of individual passengers getting on a cage which serves a call after a predetermined time (t) from the registration of the call by integrating a function $y=f(x)$ for the predetermined period of time (t), $$\int_0^t f(x)\,dx$$

wherein said passenger wait time predicting means totals calls having the same registration time among the call registration times recorded for the respective calls, calculates an average number of passengers for the calls of the same registration times, calculates a summation of the wait times of the individual passengers and the call registration times, and delivers the summation as the predictive summation of the actual waiting times of individual passengers.

4. A wait time prediction apparatus for an elevator as defined in claim 3 wherein said passenger wait time-predicting means includes means holding a plurality of reference times predetermined for the totalization of the calls of the same registration time, for obtaining a number of the calls having the call registration time coincident with each of the reference times and a sum of the numbers of passengers corresponding to the calls and for calculating the average number of passengers from the obtained results.

5. A wait time prediction apparatus for an elevator as defined in claim 4 wherein said passenger wait time-predicting means includes multiplication/addition means for multiplying the average number of passengers for each of the reference times and the call registration time and adding such multiplied results in order to calculate the predictive summation of the actual waiting-times of individual passengers.

6. A wait time prediction apparatus for an elevator as defined in claim 5 wherein the reference times in said passenger wait time-predicting means are set at equal time intervals, and for calculating the predictive summation of the actual waiting times of the passengers, said multiplication/addition means including means to multiply the average number of passengers and times based on the equal time intervals and to add the multiplied results.

* * * * *